US012709912B2

(12) United States Patent
Poulin

(10) Patent No.: US 12,709,912 B2
(45) Date of Patent: Aug. 18, 2026

(54) TOWER HAVING LIGHTWEIGHT AND WEATHERPROOF CONSTRUCTION

(71) Applicant: LMO INC., Chicoutimi (CA)

(72) Inventor: André Poulin, Chicoutimi (CA)

(73) Assignee: LMO Inc.

( * ) Notice: Subject to any disclaimer, the term of this patent is extended or adjusted under 35 U.S.C. 154(b) by 0 days.

(21) Appl. No.: 18/573,078

(22) PCT Filed: Sep. 2, 2022

(86) PCT No.: PCT/CA2022/051324
§ 371 (c)(1),
(2) Date: Dec. 21, 2023

(87) PCT Pub. No.: WO2023/028710
PCT Pub. Date: Mar. 9, 2023

(65) Prior Publication Data

US 2024/0263480 A1 Aug. 8, 2024

Related U.S. Application Data

(60) Provisional application No. 63/240,010, filed on Sep. 2, 2021.

(51) Int. Cl.
*E04H 12/10* (2006.01)

(52) U.S. Cl.
CPC ..... *E04H 12/10* (2013.01)

(58) Field of Classification Search
CPC ..... E04H 12/10
See application file for complete search history.

(56) References Cited

FOREIGN PATENT DOCUMENTS

| | | | | | |
|---|---|---|---|---|---|
| CN | 103883154 | B | | 12/2015 | |
| CN | 205677251 | U | | 11/2016 | |
| CN | 208294126 | U | | 12/2018 | |
| CN | 212957924 | U | | 4/2021 | |
| GB | 2423999 | A | * | 9/2006 | ..... E04H 12/10 |
| WO | WO-2012025838 | A2 | * | 3/2012 | ..... E04H 12/10 |

* cited by examiner

*Primary Examiner* — Patrick J Maestri
(74) *Attorney, Agent, or Firm* — Philip A. Swain; Equinox IP Inc.

(57) ABSTRACT

A strengthening apparatus for a tower with two ends, one end being wider than the other. The apparatus includes a unitary V-shaped extrusion member with two arms connected to a junction. The arms are respectively secured to two outer tower frames of three legs which are disposed in a spaced apart equilateral triangle configuration. The legs are located at a tower base located near the first end of the tower. The extrusion members are made from a weatherproof material having one strength. Three stabilizers are connected to each of the legs. The stabilizers are configured to balance the tower and are made from a strengthening material having a strength sufficient to counter the first strength of the waterproof material.

19 Claims, 14 Drawing Sheets

TOWER HAVING LIGHTWEIGHT AND WEATHERPROOF CONSTRUCTION

This application is a national phase filing of PCT/CA2022/051324 and claims priority from U.S. Provisional Application Ser. No. 63/240,010 filed Sep. 2, 2021.

TECHNICAL FIELD

The present generally concerns towers, and more specifically for a tower in which a lightweight, anti-corrosion, and strongly resistant material such as aluminum, is used therein.

BACKGROUND

Steel lattices are generally used to construct communications towers and pylons. The lattice design provides low weight strength and high wind resistance. Also, this type of construction is economical while representing the most efficient structural forms. Typically, lattices with either a triangular or square cross-section are most common.

When built as a tower, the structure may be parallel-sided or taper over part or all of its height. When constructed of several sections, the tower tapers away as the height increases.

Guyed masts with supporting guy lines are typically used to strengthen the towers and reduce lateral forces such as wind loads, especially if the tower is located in an exposed region. This allows construction of narrow towers, which serves to camouflage the towers, thereby making them less of an eyesore. The towers, however, generally include support structures that are prone to weather damage and corrosion over time. If not maintained or replaced, the steel support structures can cause catastrophic failure of the tower. Maintenance and replacement, especially in a network of towers, can be costly.

Several groups have designed various bases for towers in an attempt to address the above-noted problems with limited success. Examples of such designs are:

- U.S. Pat. No. 4,745,412 for "Lightweight Tower Assemblies for Antennas and the like";
- U.S. Pat. No. 5,097,647 for Support Tower for "Communications Equipment";
- U.S. Pat. No. 5,787,673 for "Antenna Support with multi-direction adjustability";
- U.S. Pat. No. 6,668,498 for "System and method for supporting guyed towers having increased load capacity and stability";
- U.S. Pat. No. 6,739,561 for "Antenna mounting device";
- U.S. Pat. No. 6,814,184 for "High rigidity vertical column member and structure and hoist platform system"
- U.S. Pat. No. 6,948,290 for "System and method for increasing the load capacity and stability of guyed towers";
- U.S. Pat. No. 7,823,347 for "Structural member and structural systems using structural member";
- U.S. Pat. No. 9,273,466 for "Self-supporting communication tower";
- U.S. Pat. No. 10,119,265 for "Building frame connector and method of use"; and
- Published PCT application No. PCT/IB2021/051228 for "Hot-rolled angle iron with 60-degree internal angle".

While these tower designs have many advantages, they still suffer from a number of design drawbacks, which if not addressed can lead to decreased lifetime and also stability problems. Furthermore, the choice of materials and the base design, which is a separate part of the tower construction, has its own inherent problems. Disadvantageously, as exemplified in U.S. Pat. No. 4,745,412, a set of tubular structural elements includes fin-like features which would likely require the use of cables to ensure stability of the apparatus.

Thus, there is a need for an improved, stand-alone communications tower with an apparatus for strengthening the tower, specifically in the base portion, and which is weatherproof and lightweight.

BRIEF SUMMARY

We have therefore designed a strengthening support base for a stand-alone communications tower, a freestanding tower and a pylon, which significantly reduces, or essentially eliminates, the problems associated with the designs described. The free-standing aluminum tower includes three legs made with angular aluminum extrusions that are bolted (braced) thereto. The material used is corrosion resistant and lightweight. Also, to counter the inherent weaknesses typically found in aluminum welding, the feet parts of the legs are made from galvanized steel, which provides a balancing effect to the tower. Desirably, we have added an optional feature by transforming anti-climbing plates at the tower base into a space that is sized to receive a storage cabinet. This advantageously reduces the so-called "environmental footprint" of the tower construction area.

Furthermore, in the design, the aluminum extrusions are manufactured according to art recognized manufacturing procedures and include a 60-degree-internal angle. The 60-degree internal angle is an ideal angle for a three (3)-leg stand-alone structure and is suited for use mainly in erecting telecommunications towers and in similar fields. This permits construction of three-leg towers at lower costs and lower manpower, as well as ensuring higher structural endurance by using aluminum extrusion, and strength as compared to three-leg towers erected by conventional means, which are typically made from steel.

Accordingly, in one embodiment there is provided a strengthening apparatus for a tower having first and second end portions, the first end portion being wider than the second end portion, the apparatus comprising:

- a unitary V-shaped extrusion member having first and second arms connected to a junction, the first and second arms being respectively secured to first and second outer tower frames of first, second and third legs disposed in a spaced apart equilateral triangle configuration, the legs being located at a tower base portion located near the first end portion of the tower, the extrusion members being made from a weatherproof material having a first strength; and
- first, second and third stabilizing members connected to each of the first, second and third legs, the stabilizing members being configured to balance the tower, the stabilizing members being made from a strengthening material having a second strength sufficient to counter the first strength of the waterproof material.

In one example, the first and second arms of the unitary V-shaped extrusion member includes a securing member. The securing member each includes first and second plates and an opening therethrough to receive a bolt.

In one example, the junction of the unitary V-shaped extrusion member includes an arcuate inner wall and an apex point.

In one example, the unitary V-shaped extrusion member has an internal angle of about 60-degrees.

In one example, the weatherproof material is an extrusion of aluminum.

In one example, the strengthening material is galvanized steel, angled at about 60-degrees.

In one example, the base portion includes an area defined to receive therein a storage cabinet.

In one example, the first, second and third stabilizing members are feet disposed to provide balance to the tower.

In one example, the tower is a stand-alone communications tower, a pylon or a free-standing tower.

Accordingly, in another embodiment there is provided a stand-alone communications tower, comprising:

a tower base portion located near a first end portion of the tower, the base portion having first, second and third legs disposed in a spaced apart equilateral triangle configuration, each leg having a unitary V-shaped extrusion member with first and second arms connected to a junction, the first and second arms being respectively secured to first and second outer tower frames of the legs, the extrusion members being made from a weatherproof material having a first strength; and first, second and third stabilizing members connected to each of the first, second and third legs, the stabilizing members being configured to balance the tower, the stabilizing members being made from a strengthening material having a second strength sufficient to counter the first strength of the waterproof material.

In one example, the first and second arms of the unitary V-shaped extrusion member includes a securing member. The securing member each includes first and second plates and an opening therethrough to receive a bolt.

In one example, the junction of the unitary V-shaped extrusion member includes an arcuate inner wall and an apex point.

In one example, the unitary V-shaped extrusion member has an internal angle of about 60-degrees.

In one example, the weatherproof material is an extrusion of aluminum.

In one example, the strengthening material is galvanized steel, angled at about 60-degrees.

In one example, the base portion includes an area defined to receive therein a storage cabinet.

In one example, the first, second and third stabilizing members are feet disposed to provide balance to the tower.

In one example, the communications tower includes at least one strengthening zones spaced apart along the length of the tower.

In another example, the communications tower in which each strengthening zone includes three unitary V-shaped extrusion members disposed in a spaced apart equilateral triangle configuration.

BRIEF DESCRIPTION OF THE DRAWINGS

These and other features of that described herein will become more apparent from the following description in which reference is made to the appended drawings wherein.

DETAILED DESCRIPTION

Definitions

Unless otherwise specified, the following definitions apply:

The singular forms "a", "an" and "the" include corresponding plural references unless the context clearly dictates otherwise.

As used herein, the term "comprising" is intended to mean that the list of elements following the word "comprising" are required or mandatory but that other elements are optional and may or may not be present.

As used herein, the term "consisting of" is intended to mean including and limited to whatever follows the phrase "consisting of". Thus, the phrase "consisting of" indicates that the listed elements are required or mandatory and that no other elements may be present.

Figure 1:
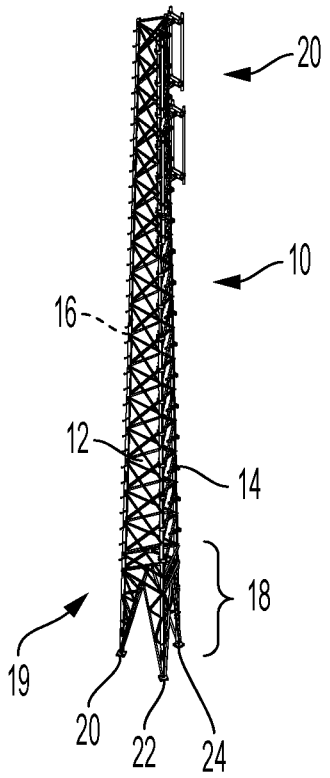
FIG. 1 is a perspective view of a stand-alone telecommunications tower.
Figure 2:
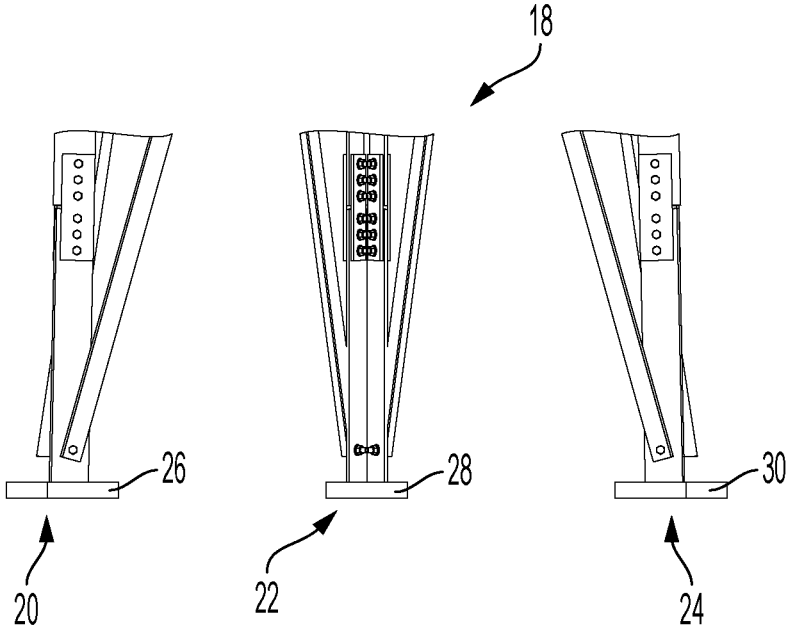
FIG. 2 is a close-up side view of a tower base portion showing three legs.

Referring now to FIGS. 1 and 2, a stand-alone communications tower is shown generally at 10 in which first, second and third latticed sides 12, 14, 16 extend from a tower base portion 18 located near a first end portion 19 of the tower to a narrow upper end portion 20. The tower base portion 18 includes three legs 20, 22, 24 that are spaced apart in the form of a spaced apart equilateral triangle configuration. At the base of each of the three legs 20, 22, 24 are three feet 26, 28, 30. In the examples shown, the communications tower 10 is a telecommunications tower such as the type used for wireless transmission. A person of ordinary skill in the art will recognize that many types of towers are available, such as a pylon, a free-standing tower, and the like.

Figure 3C:
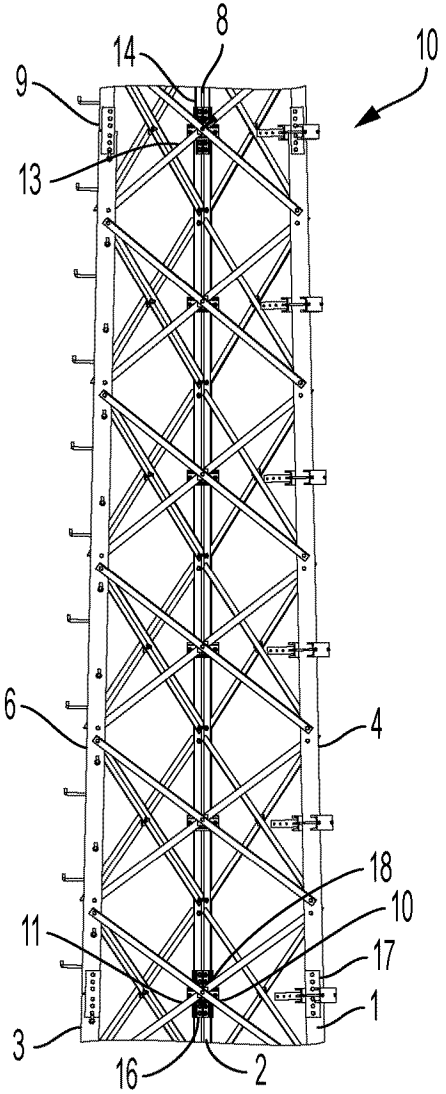
FIG. 3C is a side view of a middle portion of the communications tower showing the location of two strengthening members.
Figure 3B:
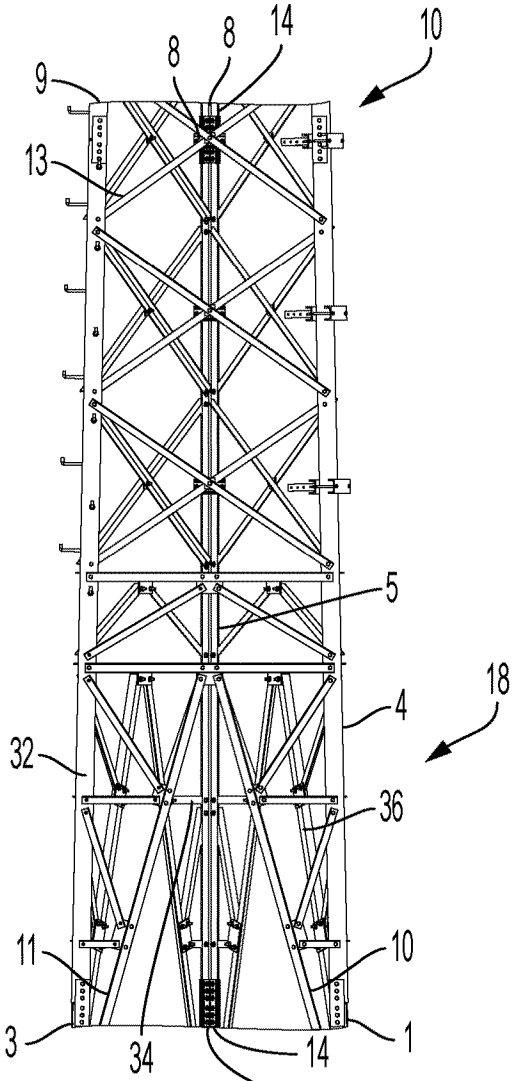
FIG. 3B is a side view of FIG. 3A showing the location of the base portion and strengthening members.
Figure 3A:
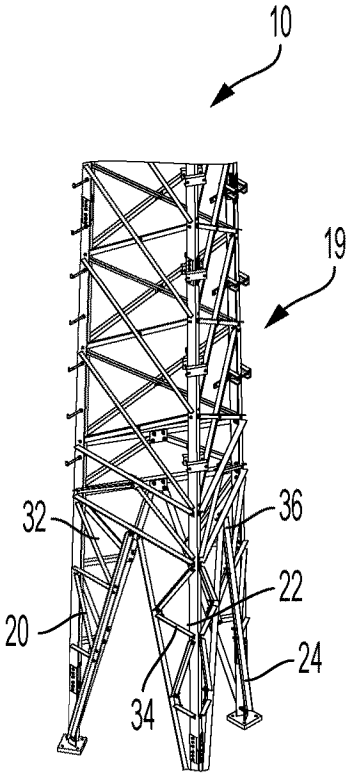
FIG. 3A is a perspective view of the base portion of the tower showing a latticework frame.
Figure 4:
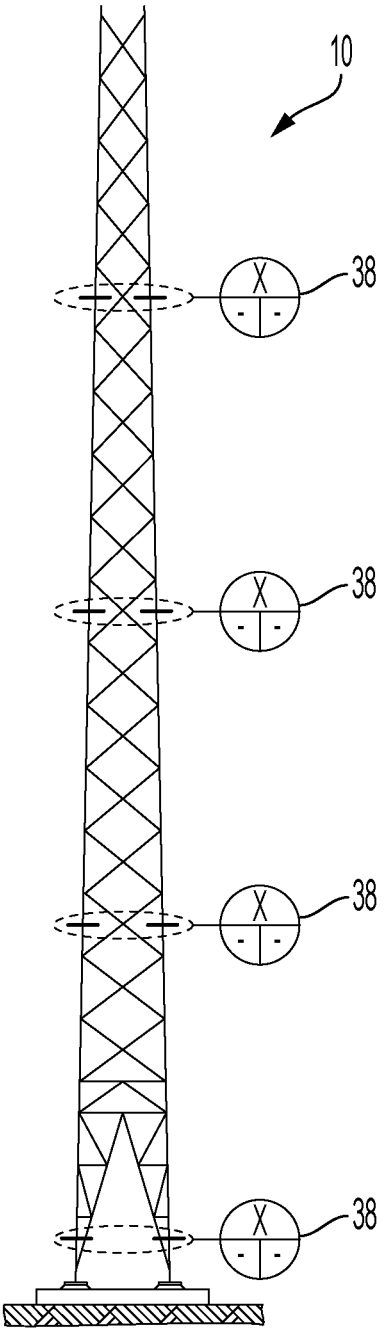
FIG. 4 is a diagrammatic representation of a stand-alone telecommunications tower showing the location of four spaced-apart strengthening apparatuses.
Figure 5A:
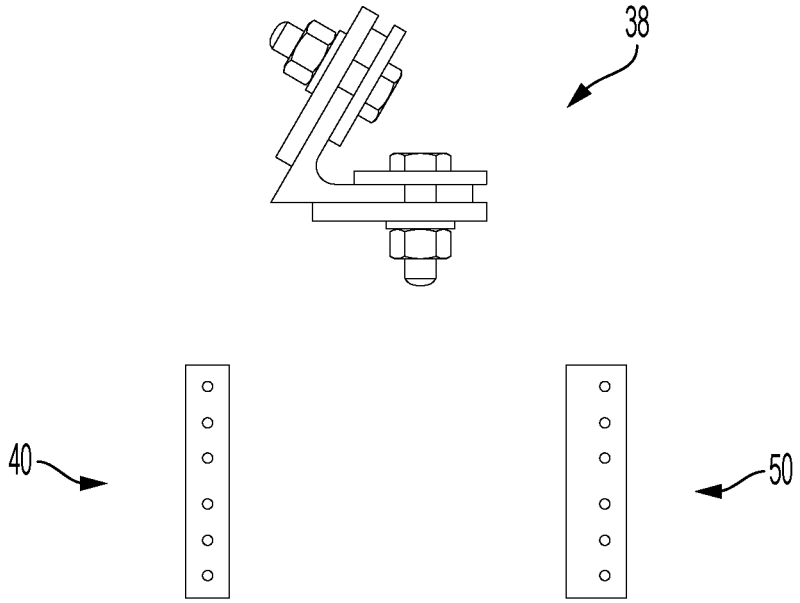
FIG. 5A is a diagrammatic representation of a first V-shaped insert with two securing members.
Figure 5B:
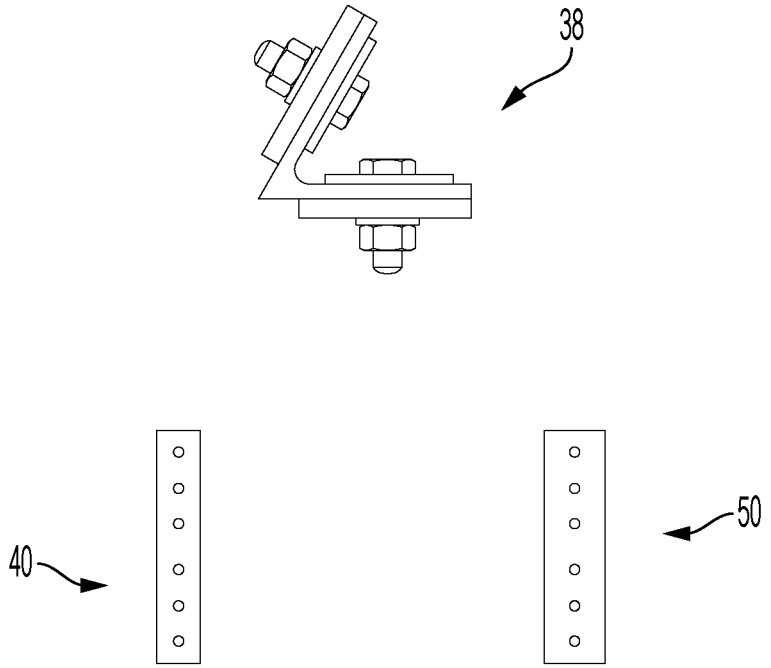
FIG. 5B is a diagrammatic representation of another V-shaped insert with two securing members.

Referring now to FIGS. 3A, 3B, and 3C, there is shown three parts of the telecommunications tower 10 and in particular three latticework frame sides 32, 34, 36.

Referring now to FIGS. 4 through 8, the communications tower 10 shows the location of four strengthening zones 38, which are spaced apart along the length of the tower 10. Each of the three legs 20, 22, 24 has a unitary V-shaped extrusion member 40 which are disposed in an equilateral triangle configuration. Given that the unitary V-shaped extrusion members 40 are essentially identical, only one will be described in detail for the sake of brevity. The unitary V-shaped extrusion member 40 includes first and second arms 42, 44 connected to a junction 46. The first and second arms 42, 44 are respectively secured ("braced") to first and second outer tower frames 48, 50 of the legs. Advantageously, the extrusion members 40 are constructed from a weatherproof material having a first strength. The junction 46 of the unitary V-shaped extrusion member 40 includes an arcuate inner wall 52 and an apex point 54.

Furthermore, and advantageously, the V-shaped extrusion member 40 is made by a reproducible and highly art-recognized processes to create the V-shape with preferably about a 60 degree-internal angle. The V-shaped extrusion member 40 is developed for use mainly in erecting telecommunications towers and in similar fields. The shape and design permit the extrusion member 40 to allow the construction of three-legged towers with lower costs and lower manpower, as well as ensuring higher structural endurance and strength as compared to three-leg towers erected by using conventional means. The V-shaped extrusion members when formed as part of the strengthening zones 38, especially for use with a tower 10 that decreases in size from the tower base portion upwards, will of course decrease in size according to the size of the three latticework walls.

Figure 6:
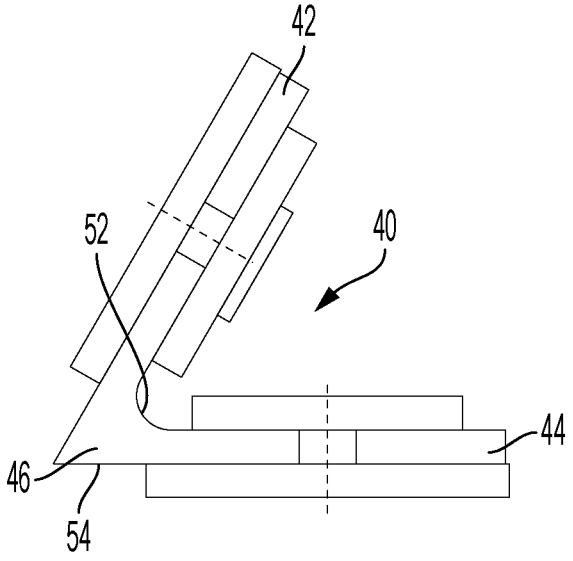
FIG. 6 is a plan view of a V-shaped insert showing location of securing openings.
Figure 7:
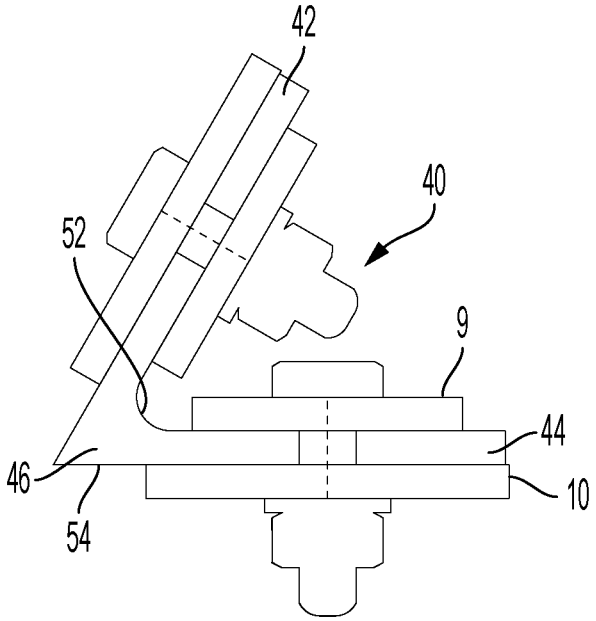
FIG. 7 is a plan view of a V-shaped insert showing the location of two securing members on each arm thereof.
Figure 8:
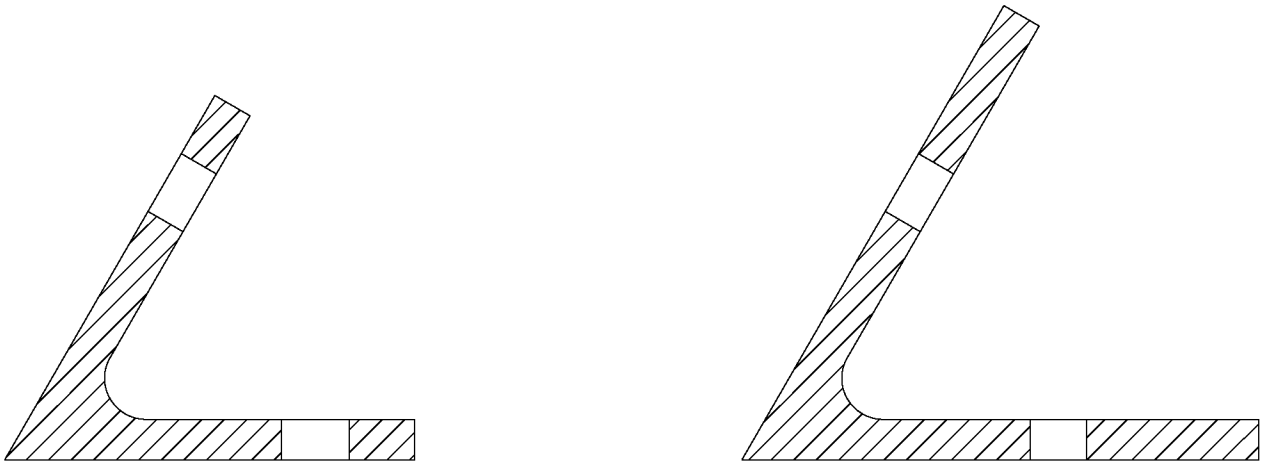
FIG. 8 is a plan view of two V-shaped inserts showing the 60-degree internal angle together with the dimensions of each arm.

Referring specifically to FIGS. 6 and 7, the first and second arms 42, 44 are each respectively secured (braced) to first and second outer tower frames of the legs using bolts 56, 58. The arms 42, 44 include first and second openings 60, 62 therein to receive the bolts 56, 58.

Advantageously, the extrusion members 40 are made from a weatherproof material having a first strength. The extrusion members 40 are connected to each of the first, second and third legs. The stabilizing zones 38 include the extrusion members 40 that are configured to balance the tower 10. The extrusion members 40 are made from a strengthening material having a second strength sufficient to counter the first strength of the waterproof material. In the examples shown, the material from which the V-shaped extrusions members are made is aluminum. The strengthening material is galvanized steel angled at about 60-degrees. The 60-degree angle allows two plates to be welded together. This provides a perfect fit with the angled aluminum and allows tight connection with four (4) aluminum plates, having two (2) insides and two (2) outside with fastening bolts.

By way of example, there are international standards for using certain metals and their alloys, such as aluminum, steel and the like, in communications tower construction. The following standards are given by way of illustration and example:

Canada:

Certification of companies for fusion welding of aluminum; CSA W59.2-M (1991) Welded Aluminum Construction; W55.3-08

CSA W47.1 CSA W47.1:19 Certification of companies for fusion welding of steel and CSA W59.1. W59-18 Welded steel construction (R2013) Certification of companies for resistance welding of steel and aluminum; CSA S157-17 6061 T6; CSA G40.21 300 W; ASTM F3125 grade A-325.

USA:

TIA-222-H; AWS D1.2/D1.2 M 2014, Structural Welding code—aluminum; AWS D8.14; AWS D18.1. D1.1 Structural Welding Code—Steel United Kingdom:

PD 6705-2 Structural use of steel and aluminum Recommendations for the execution of steel bridges to BS EN 1090-2; PD 6705-3 Structural use of steel and aluminum Recommendations for execution of aluminum structures to BS EN 1090-3

International Organization for Standardization (ISO) Standards:

ISO 9692-3 Welding and allied processes. Joint preparation. Part 3: TIG and MIG welding of aluminum and its alloys; ISO 9606 Qualification test of welders—Fusion welding, parts 1 to 5.

Europe:

EN 1090-1 Execution of steel structures and aluminum structures—Part 1: Requirements for conformity assessment of structural components; EN 1090-2 Execution of steel structures and aluminum structures—Part 2: Technical requirements for steel structures; EN 1090-3 Execution of steel structures and aluminum structures—Part 3: Technical requirements for aluminum structures; EN 1011-4 Welding—Recommendations for welding of metallic materials—Part 4: Arc Welding of aluminum alloys.

Figure 9:
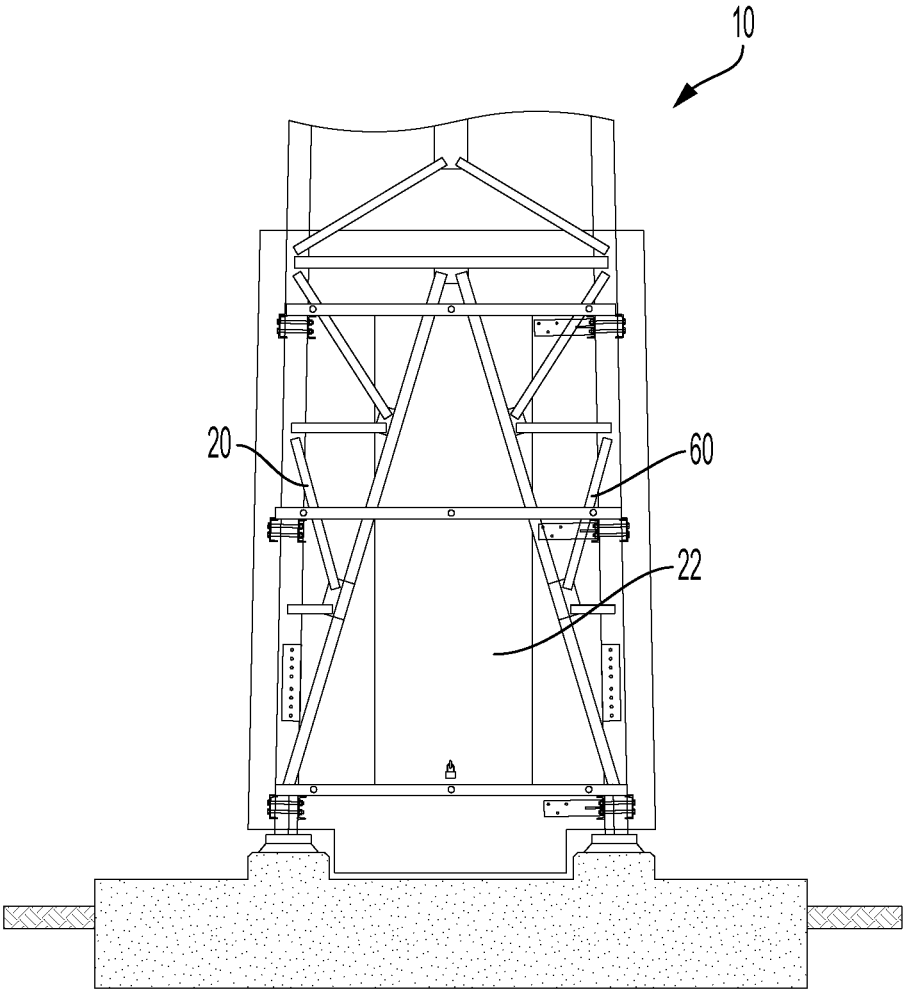
FIG. 9 is a side view of the base portion of the tower showing the location of a storage cabinet.

Referring now to FIG. 9, an alternative embodiment is included in which at the tower base portion 18, a storage container 60 is located between the three legs 20, 22, 24. The storage container 60 has includes a narrow base 62 centrally located between the tower feet 26, 28, 30.

Figure 10:
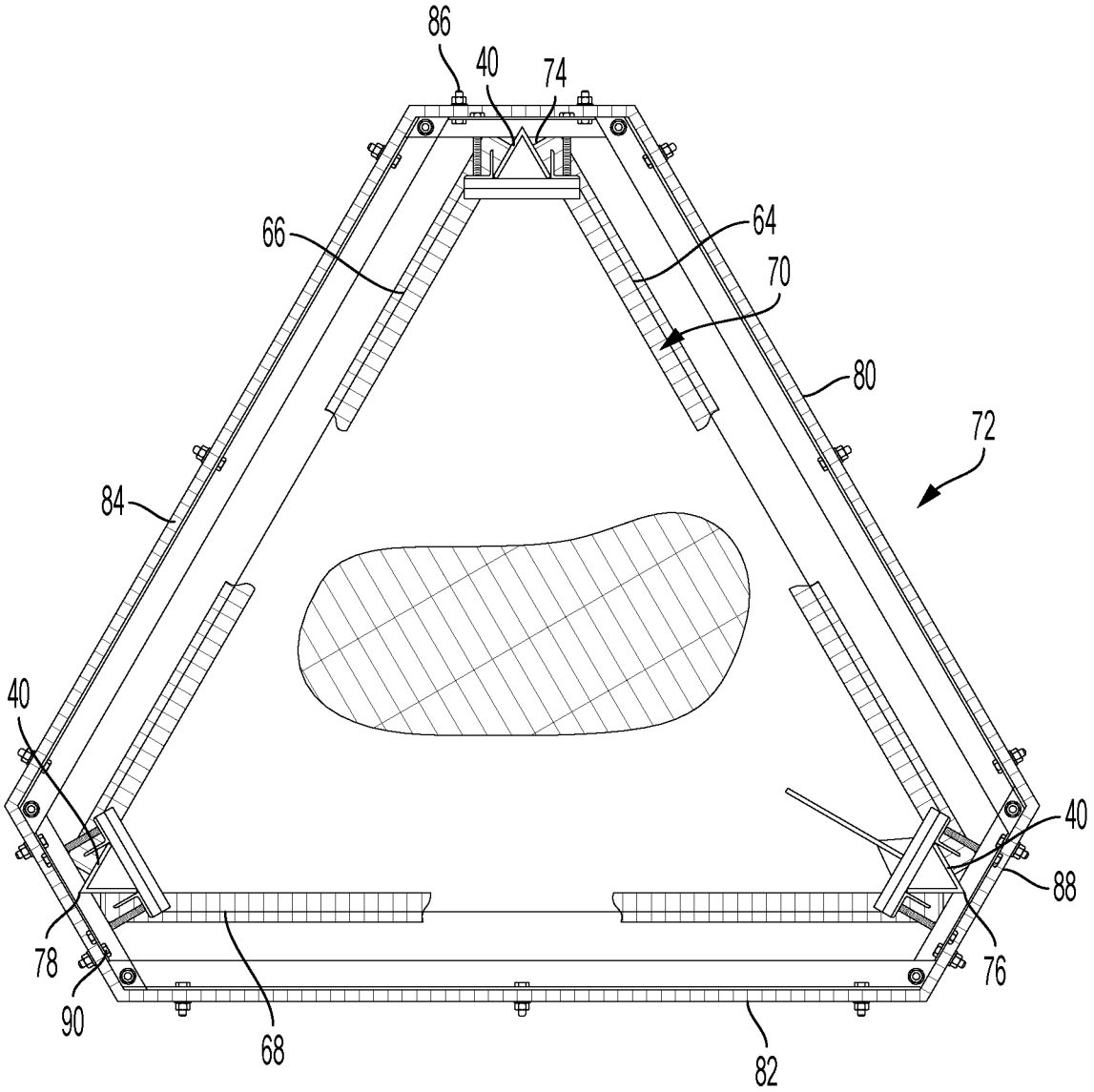
FIG. 10 is a plan view of an equilateral triangle configuration with three V-shaped inserts, an external framework and an internal framework.
Figure 11:
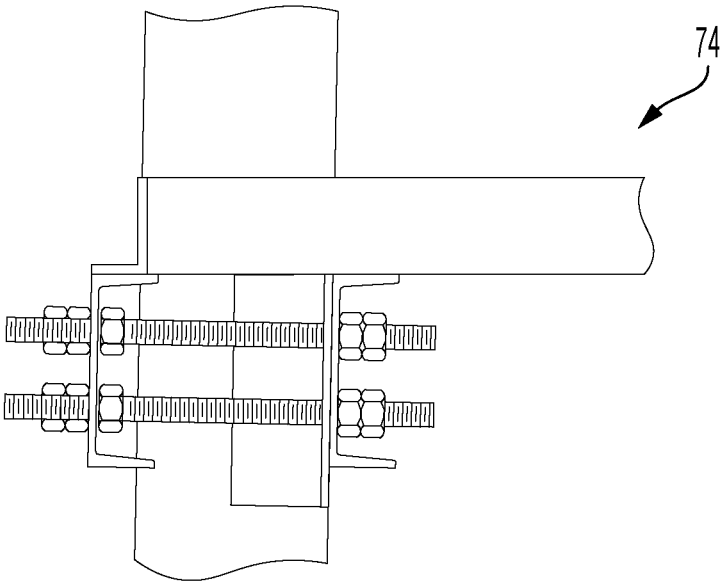
FIG. 11 is a cross-sectional side view of connection point.
Figure 12:
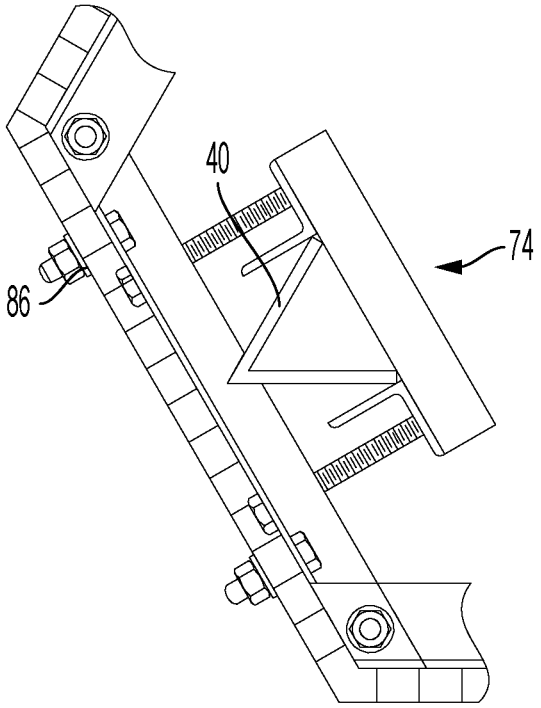
FIG. 12 is a plan view of the connection point of FIG. 11 adjacent a flat beam of the external framework.
Figure 13:
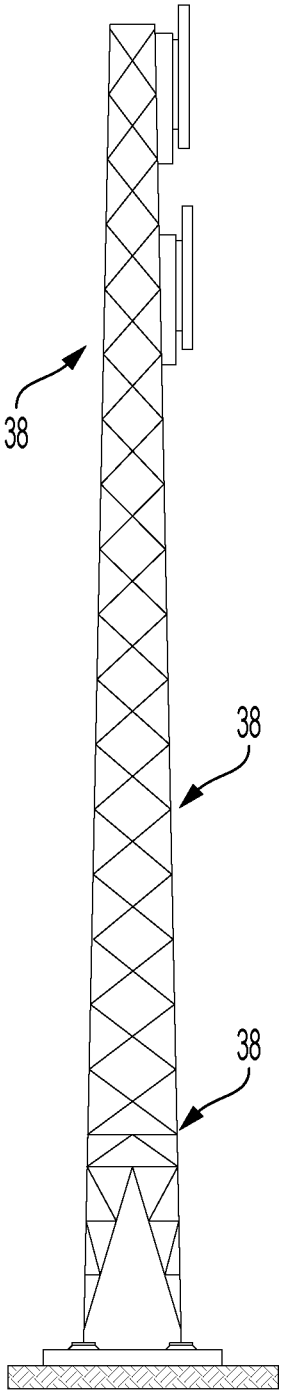
FIG. 13 is a diagrammatic representation of an embodiment of a telecommunications tower showing three strengthening members.
Figure 14:
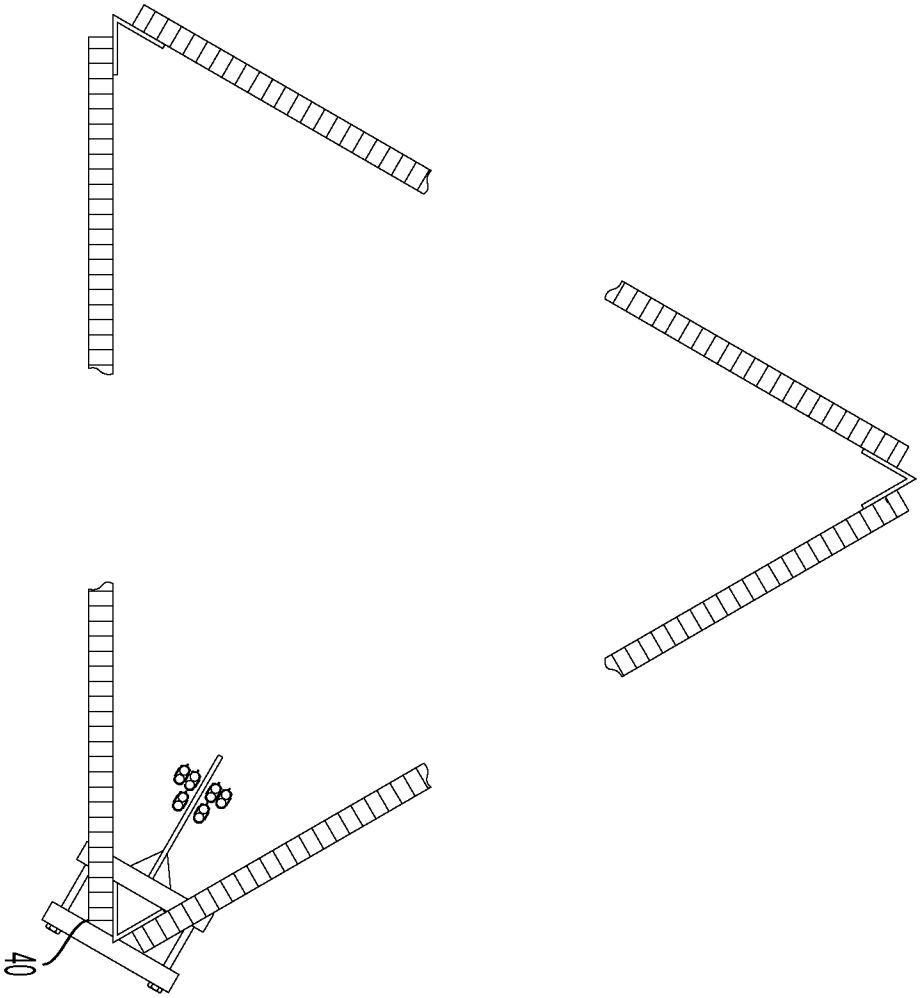
FIG. 14 is a plan view of an internal framework showing three connection points.
Figure 15:
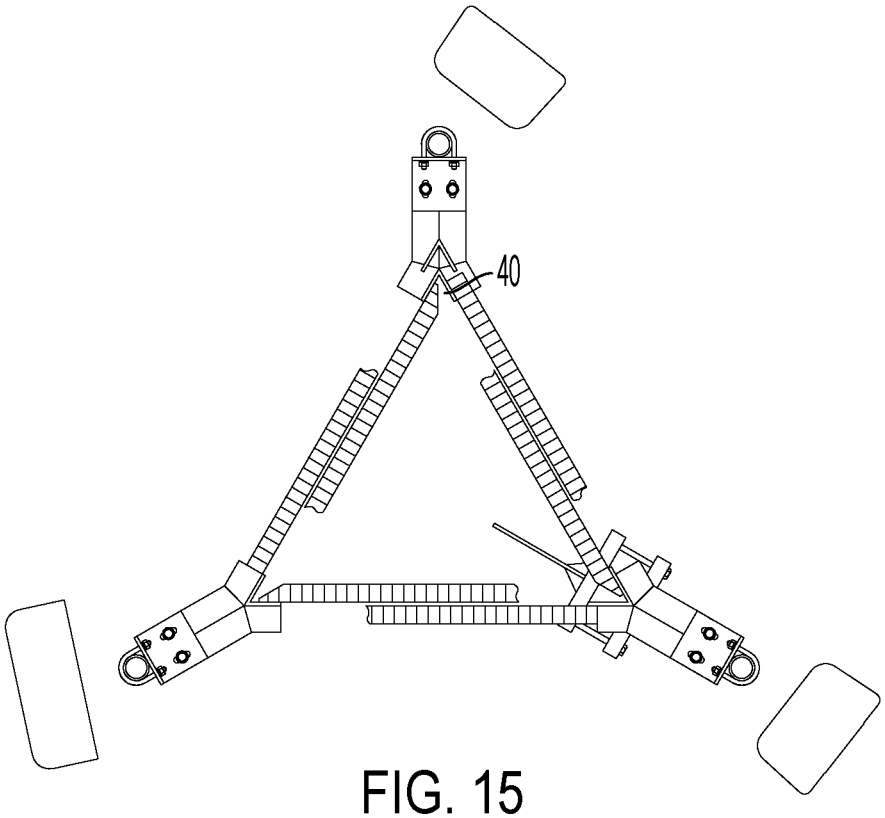
FIG. 15 is a plan view of another internal framework showing three connection points.
Figure 16:
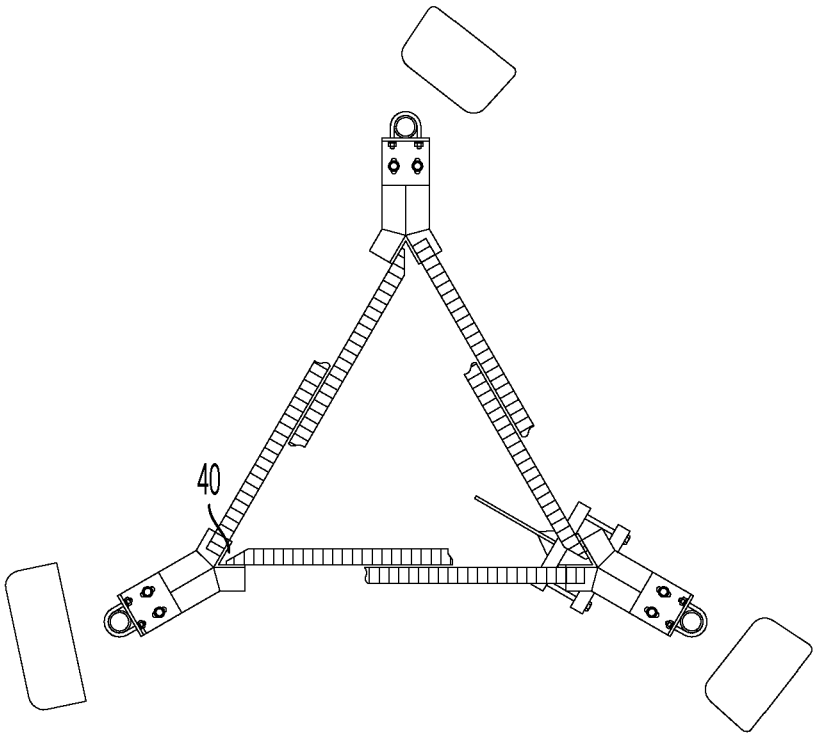
FIG. 16 is a plan view of another internal framework showing three connection points.
Figure 17:
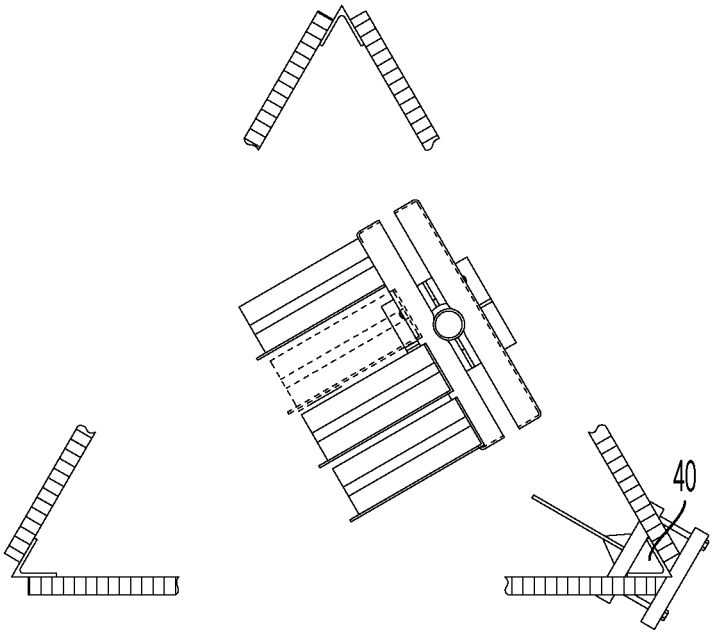
FIG. 17 is a plan view of another internal framework showing three connection points.
Figure 18:
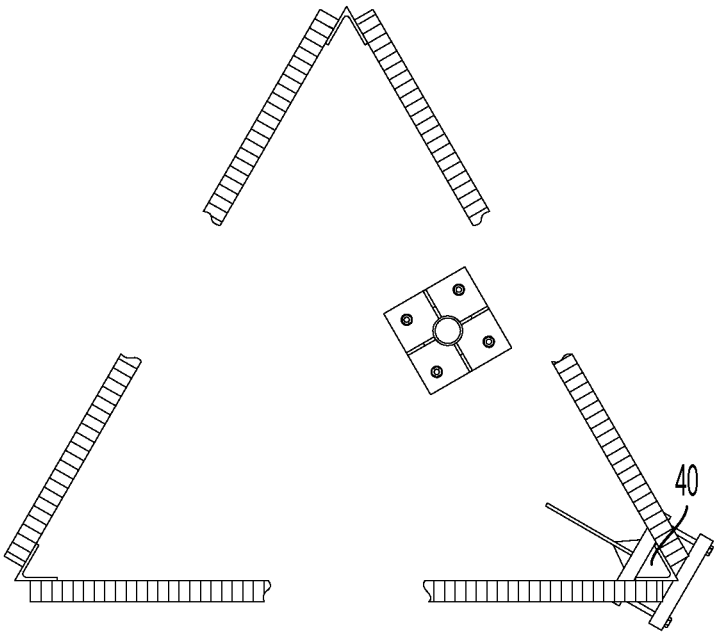
FIG. 18 is a plan view of another internal framework showing three connection points.

Referring now to FIGS. 10, 11 and 12, to further exemplify the stabilizing aspects of the strengthening zones 38, the location of three V-shaped extrusion members 40 are configured to form an equilateral triangular shape. Three bracing beams 64, 66, 68 are connected to each of the extrusion members 40 to form an internal framework 70. To further stabilize the internal framework 70, an external framework 72 is connected to the exterior of the internal framework 70. Three connection points 74, 76, 78 are located at the apex of each of the triangle corners. Three external beams 80, 82, 84 are bolted to the extrusion members 40. Three flat beams 86, 88, 90 are connected to the connection points 74, 76, 78 to form "cut-off" ends when the external framework 72 is view from above.

Referring to FIGS. 13 through 18, various equilateral triangle-configured stabilizing zones 38 are illustrated, which show the location of the extrusion members 40 that are generally disposed in an equilateral triangular configuration.

Figure 19:
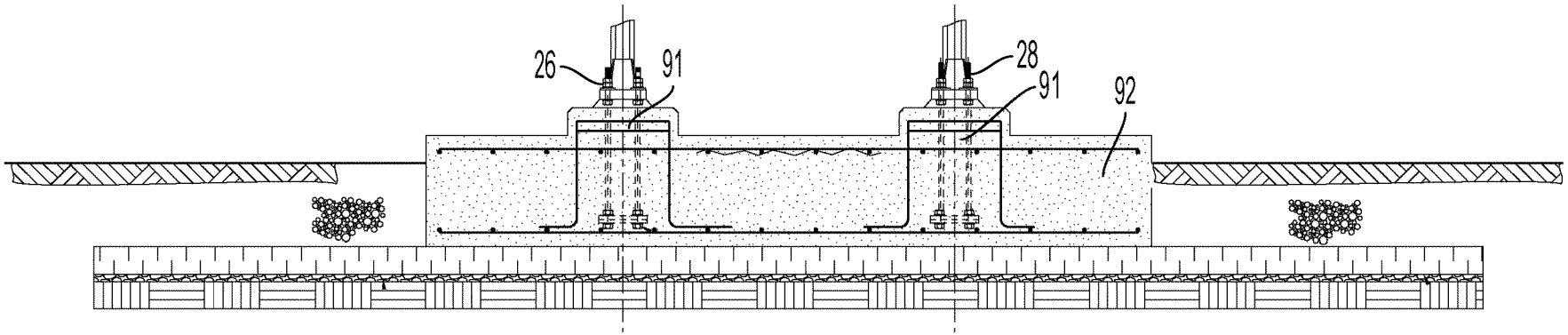
FIG. 19 is a cross sectional side view of a securing slab showing two feet mounted therein.

Referring now to FIG. 19, the tower base portion 18 of the tower 10, as noted above, includes three feet 26, 28, 30 a lower portion 91 of each being embedded in a slab member 92. The slab member 92 is embedded in the ground to cover an area that is determined the stability of the tower 10, and is minimally invasive to the environment nearby.

Other Embodiments

From the foregoing description, it will be apparent to one of ordinary skill in the art that variations and modifications may be made to the embodiments described herein to adapt it to various usages and conditions.

What is claimed is:

1. A strengthening apparatus for a tower having first and second end portions, the first end portion being wider than the second end portion, the apparatus comprising:

a unitary V-shaped extrusion member having first and second arms connected to a junction, the first and second arms being respectively secured to first and second outer tower frames of first, second and third legs disposed in a spaced apart equilateral triangle configuration, the legs being located at a tower base portion located near the first end portion of the tower, the extrusion members being made from a weatherproof material having a first strength; and first, second and third stabilizing members connected to each of the first, second and third legs, the stabilizing members being configured to balance the tower, the stabilizing members being made from a strengthening material having a second strength sufficient to counter the first strength of the weatherproof material, the strengthening material is galvanized steel, the stabilizing member being shaped to have an internal angle of about 60-degrees.

2. The apparatus, according to claim 1, in which the first and second arms of the unitary V-shaped extrusion member includes a securing member.

3. The apparatus, according to claim 2, in which the securing member each includes first and second plates and an opening therethrough to receive a bolt.

4. The apparatus, according to claim 1, in which the junction of the unitary V-shaped extrusion member includes an arcuate inner wall and an apex point.

5. The apparatus, according to claim 1, in which the unitary V-shaped extrusion member has an internal angle of about 60-degrees.

6. The apparatus, according to claim 1, in which the weatherproof material is an extrusion of aluminum.

7. The apparatus, according to claim 1, in which the base portion includes an area defined to receive therein a storage cabinet.

8. The apparatus, according to claim 1, in which the first, second and third stabilizing members are feet disposed to provide balance to the tower.

9. The apparatus, according to claim 1, in which the tower is a stand-alone communications tower, a pylon or a free-standing tower.

10. A stand-alone communications tower, comprising:

a tower base portion located near a first end portion of the tower, the base portion having first, second and third legs disposed in a spaced apart equilateral triangle configuration, each leg having a unitary V-shaped extrusion member with first and second arms connected to a junction, the first and second arms being respectively secured to first and second outer tower frames of the legs, the extrusion members being made from a weatherproof material having a first strength; and first, second and third stabilizing members connected to each of the first, second and third legs, the stabilizing members being configured to balance the tower, the stabilizing members being made from a strengthening material having a second strength sufficient to counter the first strength of the weatherproof material, the strengthening material is galvanized steel, the stabilizing member being shaped to have an internal angle of about 60-degrees.

11. The communications tower, according to claim 10, in which the first and second arms of the unitary V-shaped extrusion member includes a securing member.

12. The communications tower, according to claim 11, in which the securing member each includes first and second plates and an opening therethrough to receive a bolt.

13. The communications tower, according to claim 10, in which the junction of the unitary V-shaped extrusion member includes an arcuate inner wall and an apex point.

14. The communications tower, according to claim 10, in which the unitary V-shaped extrusion member has an internal angle of about 60-degrees.

15. The communications tower, according to claim 10, in which the weatherproof material is an extrusion of aluminum.

16. The communications tower, according to claim 10, in which the base portion includes an area defined to receive therein a storage cabinet.

17. The communications tower, according to claim 10, in which the first, second and third stabilizing members are feet disposed to provide balance to the tower.

18. The communications tower, according to claim 10, includes at least one strengthening zones spaced apart along the length of the tower.

19. The communications tower, according to claim 18, in which each strengthening zone includes three unitary V-shaped extrusion members disposed in a spaced apart equilateral triangle configuration.

* * * * *